US012270391B2

(12) United States Patent
Kawai et al.

(10) Patent No.: US 12,270,391 B2
(45) Date of Patent: Apr. 8, 2025

(54) TUBE PUMP AND PRINTING APPARATUS

(71) Applicant: MIMAKI ENGINEERING CO., LTD., Nagano (JP)

(72) Inventors: Tomoya Kawai, Nagano (JP); Toshihiro Kimura, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 247 days.

(21) Appl. No.: 17/688,851

(22) Filed: Mar. 7, 2022

(65) Prior Publication Data

US 2022/0355598 A1 Nov. 10, 2022

(30) Foreign Application Priority Data

May 10, 2021 (JP) ..... 2021-079515

(51) Int. Cl.
*F04B 43/08* (2006.01)
*F04B 43/12* (2006.01)

(52) U.S. Cl.
CPC ..... *F04B 43/1276* (2013.01)

(58) Field of Classification Search
CPC .. F04B 43/1276; F04B 43/1253; F04B 43/12; F04B 43/08
USPC ..... 417/477.6, 477.7, 477.8
See application file for complete search history.

(56) References Cited

U.S. PATENT DOCUMENTS 6,641,249 B2 * 11/2003 Miyauchi ..... B41J 2/16523 347/30

FOREIGN PATENT DOCUMENTS

| | | |
|---|---|---|
| JP | 2003019816 | 1/2003 |
| JP | 2015044296 | 3/2015 |
| JP | 2020172887 | 10/2020 |

OTHER PUBLICATIONS

"Notification of Reasons for Rejection of Japan Counterpart Application", issued on Apr. 2, 2024, with English translation thereof, p. 1-p. 12.

* cited by examiner

*Primary Examiner* — Philip E Stimpert
*Assistant Examiner* — Dnyanesh G Kasture
(74) *Attorney, Agent, or Firm* — JCIPRNET

(57) ABSTRACT

A tube pump that sends a fluid includes a tube, a roller, and a roller holder. In the roller holder, a guide groove is formed that receives a shaft of the roller and defines a range in which the roller is movable with respect to the roller holder. The roller holder has an inner side surface and an outer side surface as surfaces defining the guide groove in the roller holder. The inner side surface has a protrusion protruding toward the outer side surface.

10 Claims, 7 Drawing Sheets

TUBE PUMP AND PRINTING APPARATUS

CROSS REFERENCE TO RELATED APPLICATIONS

This application claims the priority benefit of Japanese Patent Application No. 2021-079515, filed on May 10, 2021. The entirety of the above-mentioned patent application is hereby incorporated by reference herein and made a part of this specification.

TECHNICAL FIELD

The present disclosure relates to a tube pump and a printing apparatus.

DESCRIPTION OF THE BACKGROUND ART

Conventionally, a tube pump, with which a fluid is sent using a tube, has been used in various technical fields. For example, Japanese Unexamined Patent Publication No. 2020-172887 discloses a use of a tube pump (tube type pump device) in an inkjet printing apparatus that is a printing apparatus employing an inkjet method for performing printing. The tube pump includes, for example, a tube, a roller, and the like, and sends a fluid such as liquid by squeezing the tube with the roller. Furthermore, in this case, for example, the squeeze operation by the roller is repeated in a predetermined zone of the tube, with the roller caused to orbit around a predetermined center axis.

In the tube pump, a movement of the roller that has finished squeezing the tube, caused by the elasticity of the tube, may result in production of hitting sound (collision noise) that is unpleasant noise. More specifically, in the tube pump, a member in which a guide groove for holding a shaft of a roller is formed may be used as a roller holder which is a member for holding the roller. As the guide groove, a groove in which the shaft of the roller is movable within a certain range may be used. In this case, the roller holder holds the shaft of the roller at the position of one end of the guide groove, for example, at a tube squeezing timing. In this case, the roller may move in the guide groove toward the other end with a huge momentum, due to the elasticity of the tube, at a tube squeezing end timing. As a result, the roller may collide with the end of the guide groove, and the hitting sound thus produced by the collision may be accepted as unpleasant noise by a user.

In view of this, various configurations for preventing such production of hitting sound have been conventionally studied. For example, Japanese Unexamined Patent Publication No. 2020-172887 discloses a configuration using a guide member that comes into contact with a roller to regulate the movement of the roller. Nevertheless, there is still a demand for a new and more preferable configuration for preventing such production of hitting sound. All things considered, the present disclosure provides a tube pump and a printing apparatus.

SUMMARY

An aspect of the disclosure provides a tube pump configured to send a fluid by using an elastic tube. The tube pump includes: the tube through which the fluid passes; a roller configured to move along a partial zone in a flow path in which the fluid is sent through the tube, while crushing the tube, to push out the fluid in the tube; and a roller holder configured to make the roller orbit around a predetermined center axis to make the roller repeatedly pass through a path along the partial zone, the roller holder being a member that makes the roller move while holding a shaft of the roller. In the roller holder, a guide groove is formed to have one end side and another end side, in a movement orientation in which the roller moves along the partial zone to push out the fluid, respectively defined as a rear side and a front side, the guide groove being a groove that receives the shaft of the roller to define a range in which the roller is movable with respect to the roller holder. The roller holder includes, as surfaces defining the guide groove: an inner side surface that is a surface guiding a movement of the shaft of the roller on a side closer to the center axis than the shaft of the roller; and an outer side surface that is a surface facing the inner side surface with the shaft of the roller interposed in between. While the roller moves along the partial zone, the shaft of the roller is held at a rear end position that is a position at an end on the rear side in the movement orientation in the guide groove. The inner side surface has a protrusion protruding toward the outer side surface.

BRIEF DESCRIPTION OF THE DRAWINGS

FIG. 1A illustrates an example of a configuration of a main part of the printing apparatus 100, FIG. 1B illustrates an example of a configuration of an ink supply path 108, and FIG. 1C illustrates an example of a configuration of a maintenance unit 114.

FIGS. 2A and 2B illustrate examples of states of a tube pump 200 of the reference example at different timings during forward rotation of the tube pump 200.

FIG. 3A illustrates an example of a configuration of the tube pump 200 of the present example, and FIG. 3B illustrates shapes of a guide grooves 300 of the reference example and the present example for comparison.

DETAILED DESCRIPTION OF EMBODIMENTS

Figure 1A:
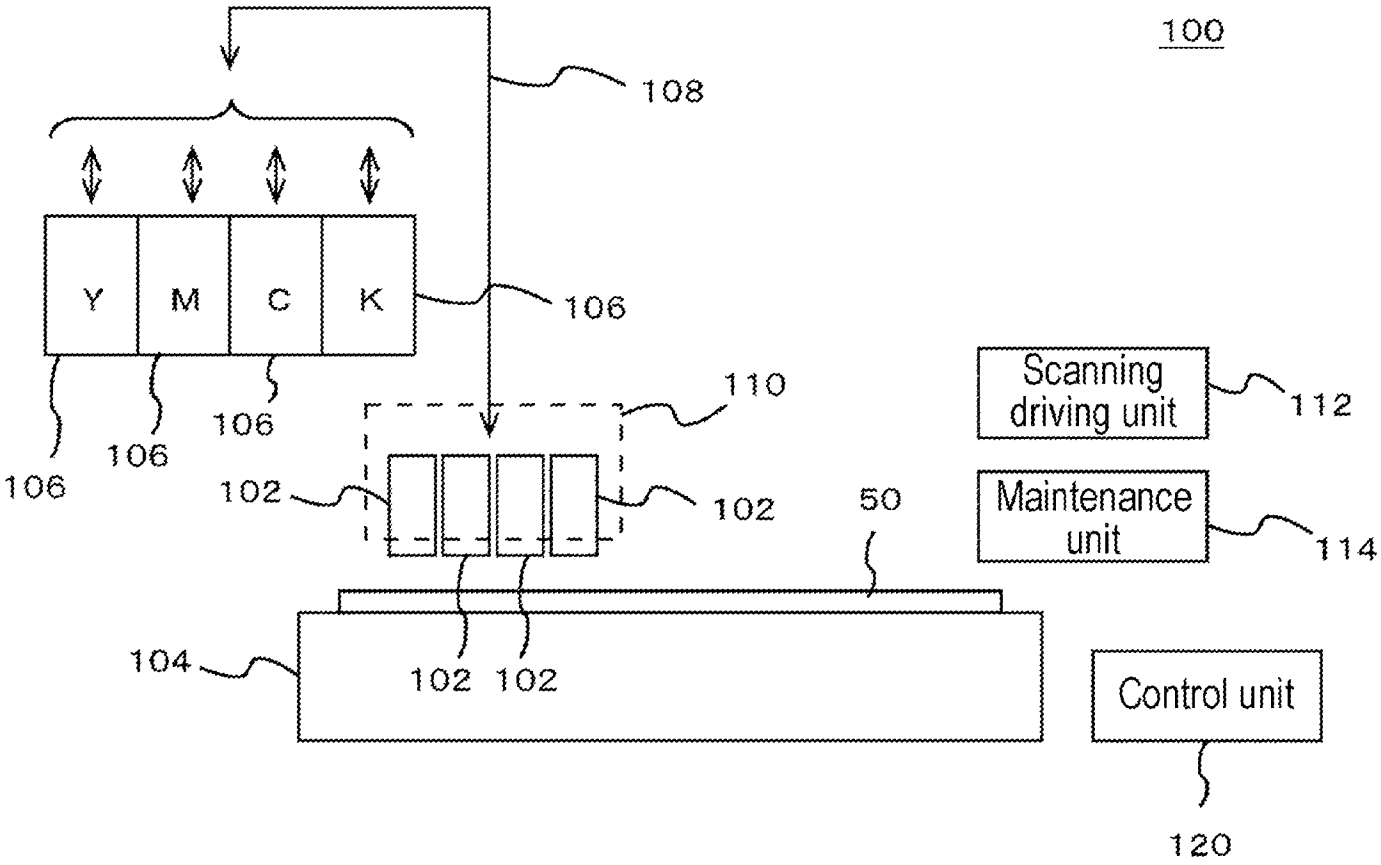
FIGS. 1A to 1C are diagrams illustrating a printing apparatus 100 according to an embodiment of the present disclosure. Specifically.

The inventors of the present application have conducted intensive studies on a configuration with which production of hitting sound due to movement of a shaft of a roller in a guide groove of a roller holder can be appropriately prevented. As a result, the present inventors have found that the production of the hitting sound may be appropriately prevented by providing a protrusion on a surface, of surfaces defining the guide groove, on a side close to a center axis around which the roller orbits. Through further intensive studies, the present inventors have found the features required for achieving such an effect, and arrived at the present disclosure.

The present disclosure relates to a tube pump configured to send a fluid by using an elastic tube, the tube pump including: the tube through which the fluid passes; a roller configured to move along a partial zone in a flow path in which the fluid is sent through the tube, while crushing the tube, to push out the fluid in the tube; and a roller holder configured to make the roller orbit around a predetermined center axis to make the roller repeatedly pass through a path along the partial zone, the roller holder being a member that makes the roller move while holding a shaft of the roller, in which in the roller holder, a guide groove is formed to have one end side and another end side, in a movement orientation in which the roller moves along the partial zone to push out the fluid, respectively defined as a rear side and a front side, the guide groove being a groove that receives the shaft of the roller to define a range in which the roller is movable with respect to the roller holder, the roller holder includes, as surfaces defining the guide groove, an inner side surface that is a surface guiding a movement of the shaft of the roller on a side closer to the center axis than the shaft of the roller, and an outer side surface that is a surface facing the inner side surface with the shaft of the roller interposed in between, while the roller moves along the partial zone, the shaft of the roller is held at a rear end position that is a position at an end on the rear side in the movement orientation in the guide groove, and the inner side surface has a protrusion protruding toward the outer side surface.

With this configuration, due to the guide groove having the protrusion, for example, the roller that has dislodged from the rear end position of the guide groove can be appropriately prevented from colliding with the opposite end of the guide groove with a huge momentum. Thus, it is possible to appropriately prevent production of large hitting sound due to collision between the wall surface of the guide groove and the roller for example. With this configuration, the tube pump featuring excellent quietness can be appropriately provided for example.

In the present example, the tube is disposed to be at least partially curved in an arc shape, for example. The roller holder makes the roller orbit around the center axis, by rotating around the center axis determined based on a part of the tube having the arc shape, while the shaft of the roller is being held by the guide groove, for example. In this case, the partial zone is a zone including the arc-shaped part in the tube. With this configuration, for example, the tube can be appropriately squeezed by the roller, so that the fluid such as liquid in the tube can be appropriately sent.

The partial zone can be regarded as, for example, a squeeze zone in which the tube is squeezed by the roller, or the like. In this case, at the timing of passing through the partial zone, the roller is separated from the tube by being at a position other than the curved part in the tube. In this configuration, for example the roller is preferably held on the rear end position side of the guide groove, also while the roller is separated from the tube. More specifically, in this case, while the roller holder rotates in an orientation in which the fluid is pushed out, the roller holder holds the shaft of the roller between the rear end position of the guide groove and the protrusion, for example. With this configuration, for example, the roller that has dislodged from the rear end position of the guide groove can be more appropriately and surely prevented from colliding with the opposite end of the guide groove. The operation of thus holding the shaft of the roller can be regarded as, for example, holding the shaft of the roller on the one end side of the guide groove, regardless of whether the roller is contact with the tube, during forward rotation of the roller holder rotating in the orientation of pushing out the fluid.

In this configuration, during backward rotation of the roller holder rotating in an orientation opposite to that during the forward rotation, the roller holder may hold the shaft of the roller to be more on the other end side, which is opposite to the one end side on which the shaft of the roller is held during the forward rotation, than the protrusion in the guide groove. More specifically, during the backward rotation of the roller holder, the roller holder holds the shaft of the roller to be more on the other end side than the protrusion in the guide groove for example. With this configuration, for example, the roller holder can be appropriately rotated backward, while the roller is appropriately retracted. In this case, the protrusion may be inclined larger on the one end side than on the other end side, for example. With this configuration, for example, the roller can more appropriately move beyond the protrusion when the backward rotation is switched to the forward rotation, while being more surely prevented from moving beyond the protrusion during the forward rotation.

Immediately before the timing when the roller is separated from the tube, the roller is in contact with the tube at a position near the end of the arc-shaped part of the tube, for example. The part of the tube in contact with the roller should gradually expand from the crushed state as the roller moves. In this case the protrusion on the inner side surface of the guide groove comes into contact with the roller pushed by the tube gradually expanding, to prevent the roller from moving toward the other end side (front side) beyond the protrusion in the guide groove for example. With this configuration, for example, the shaft of the roller can be appropriately held between the rear end position in the guide groove and the protrusion. In this configuration, the outer side surface of the guide groove has a recess recessed in a direction away from the inner side surface, at a position of the inner side surface facing the protrusion for example. With this configuration, the width of the guide groove can be appropriately secured also at the position provided with the protrusion, for example.

The tube pump having the configuration described above may be used in a printing apparatus that performs printing based on an inkjet method for example. In this case, the printing apparatus includes an inkjet head configured to eject ink, an ink container configured to store the ink supplied to the inkjet head, and an ink supply path through which the ink is supplied from the ink container to the inkjet head by using the tube pump, for example. With this configuration, the printing apparatus featuring excellent quietness with production of hitting sound in the tube pump appropriately prevented can be appropriately provided, for example. The printing apparatus may include a maintenance unit configured to perform maintenance on the inkjet head and the like. In this case, the maintenance unit may perform an operation such as sucking ink from the inkjet head by using the tube pump for example.

The present disclosure can appropriately provide a tube pump featuring excellent quietness, for example.

Figure 1B:
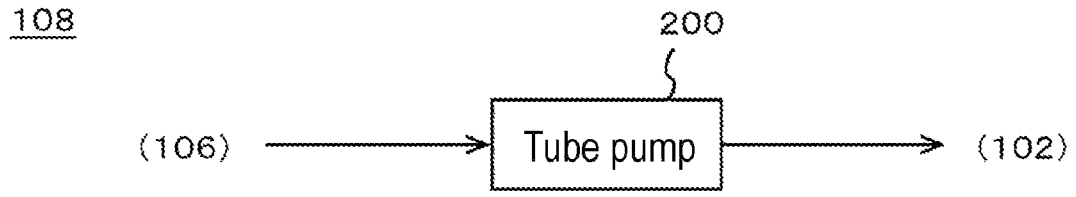
Figure 1C:
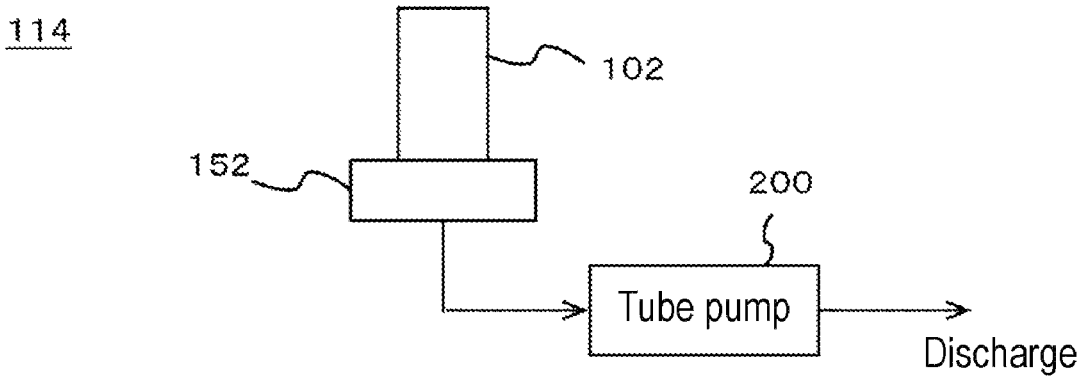

Hereinafter, an embodiment of the present disclosure will be described with reference to the drawings. FIGS. 1A, 1B, and 1C are diagrams illustrating a printing apparatus 100 according to an embodiment of the present disclosure, and FIG. 1A illustrates an example of a configuration of a main part of the printing apparatus 100. In the present example, the printing apparatus 100 is an inkjet printer that performs printing based on an inkjet method on a printing target medium (medium) 50, and includes a plurality of inkjet heads 102, a platen 104, a plurality of main tanks 106, an ink supply path 108, a carriage 110, a scanning driving unit 112, a maintenance unit 114, and a control unit 120. The printing apparatus 100 may have features that are the same as or similar to those of known inkjet printers, except for the points described below. For example, in addition to the configuration illustrated in FIGS. 1A, 1B, and 1C, the printing apparatus 100 may further include a configuration that is the same as or similar to those of known inkjet printers.

The plurality of inkjet heads 102 are ejection heads that eject ink onto the medium 50. In the present example, the plurality of inkjet heads 102 each include a plurality of nozzles, and eject ink of different colors. More specifically, in the illustrated configuration, the plurality of inkjet heads 102 eject ink of respective colors yellow (Y), magenta (M), cyan (C), and black (K). The platen 104 is a table-shaped member with which the medium 50 is held while facing the plurality of inkjet heads 102. The plurality of main tanks 106 are ink containers that store ink to be supplied to the plurality of inkjet heads 102. Furthermore, in the present example, the plurality of main tanks 106 store ink of different colors, and supply the ink to any one of the inkjet heads 102 through the ink supply path 108. As the main tank 106, for example, an ink bottle, an ink cartridge, or the like can be suitably used. The ink supply path 108 is an ink path, through which the ink is supplied from the plurality main tanks 106 to the plurality of inkjet heads 102. The carriage 110 is a holding member that holds the plurality of inkjet heads 102.

The scanning driving unit 112 is a driving unit that causes the plurality of inkjet heads 102 to perform a scanning operation of relatively moving with respect to the medium 50. In the present example, the scanning driving unit 112 causes the plurality of inkjet heads 102 to perform main scan and sub scan. In this case, the main scan can be regarded, for example, as an operation of ejecting ink while relatively moving, with respect to the medium 50, in a predetermined main scanning direction, or the like. The sub scan can be regarded, for example, as an operation of relatively moving with respect to the medium 50 in a sub scanning direction orthogonal to the main scanning direction, or the like. The maintenance unit 114 is configured to perform a maintenance operation on the plurality of inkjet heads 102. In the present example, the maintenance unit 114 performs maintenance on the inkjet head 102 by performing suction on the inkjet head 102 to suck out the ink in the inkjet head 102. The control unit 120 is, for example, a part of the printing apparatus 100 including a CPU and the like, and controls operations of parts of the printing apparatus 100, in accordance with a program (such as firmware for example) for controlling the operations of the printing apparatus 100. According to the present example, for example, the printing based on the inkjet method can be appropriately performed on the medium 50.

Furthermore, in the present example, the printing apparatus 100 is an example of a configuration using a tube pump, and executes the above-described operation using the tube pump in the ink supply path 108 and the maintenance unit 114. FIG. 1B is a diagram illustrating one example of a configuration of the ink supply path 108, and illustrates one example of a path for supplying ink from one main tank 106 corresponding to one color ink to the inkjet head 102 in a simplified manner. FIG. 1C is a diagram illustrating one example of a configuration of the maintenance unit 114, and illustrates one example of a configuration for performing suction on one inkjet head 102 corresponding to one color ink in a simplified manner. In the present example, the ink supply path 108 has the configuration illustrated in FIG. 1B for each ink color. The maintenance unit 114 has a configuration illustrated in FIG. 1C for each ink color.

As illustrated in the figure, the ink supply path 108 has a tube pump 200, for sending the ink, provided in the middle of the flow path through which the ink is supplied from the main tank 106 to the inkjet head 102. With this configuration, for example, the ink can be appropriately supplied to the inkjet head 102. The maintenance unit 114 includes a capping portion 152 and the tube pump 200. The capping portion 152 is a member that covers the nozzle surface of the inkjet head 102, when the maintenance is performed on the inkjet head 102. The tube pump 200 in the maintenance unit 114 sucks the ink from the nozzles of the inkjet head 102, by performing suction on a sealed space, including the nozzle surface of the inkjet head 102, formed by the covering using the capping portion 152. In this case, the tube pump 200 discharges the sucked ink to an ink collecting container or the like. With this configuration, for example, the maintenance can be appropriately performed on the inkjet head 102.

Figure 2A:
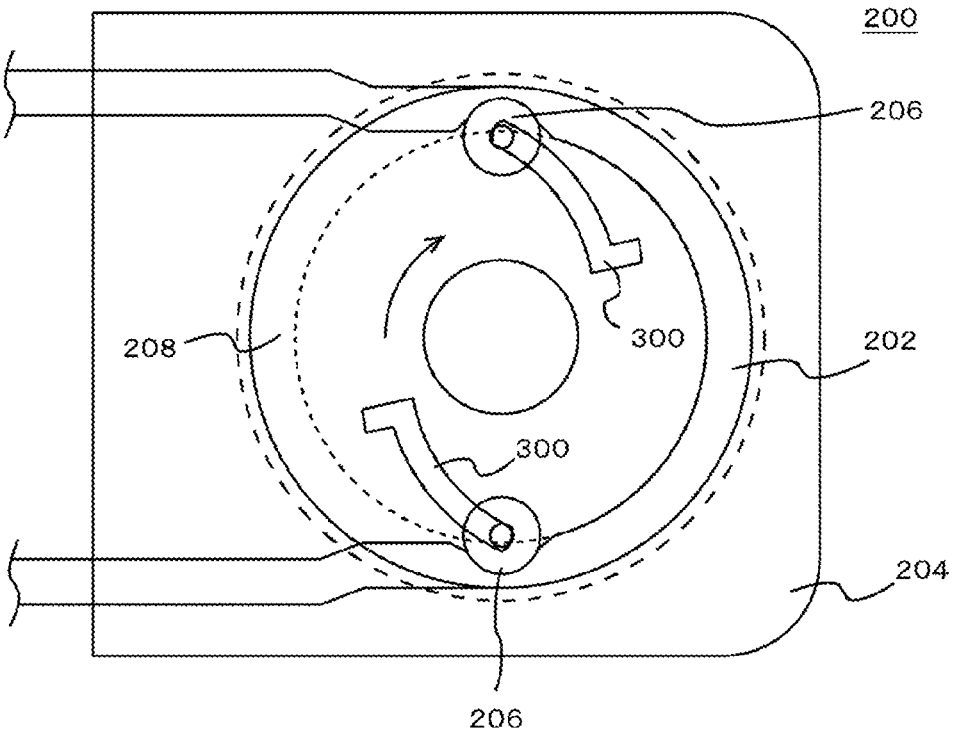
FIGS. 2A and 2B are diagrams illustrating a general feature of a tube pump 200. Specifically.
Figure 2B:
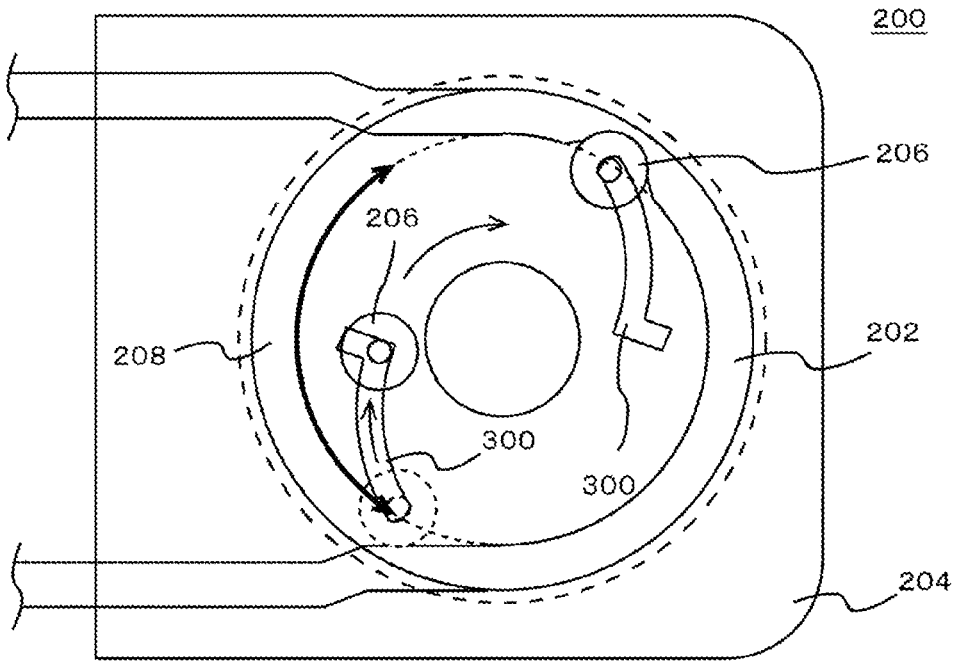

Next, features of the tube pump 200 used in the printing apparatus 100 of the present example will be described in more detail. For convenience of description, first of all, a tube pump 200 having a configuration different from that of the tube pump 200 used in the present example will be described. FIGS. 2A and 2B are diagrams illustrating general features of the tube pump 200, and illustrate an example of a configuration of the tube pump 200 (hereinafter, referred to as a tube pump 200 of the reference example) having a configuration different from that of the tube pump 200 used in the present example. FIGS. 2A and 2B illustrate examples of states of the tube pump 200 of the reference example at different timings during the forward rotation of the tube pump 200.

In FIGS. 2A and 2B, for convenience of illustration, the configuration of a main part of the tube pump 200 is illustrated while being appropriately simplified. The tube pump 200 of the reference example illustrated in FIGS. 2A and 2B can be regarded as a tube pump 200 as a result of omitting the feature parts of the tube pump 200 used in the printing apparatus 100 of the present example, or the like, for example. More specifically, as will be described in more detail later, the tube pump 200 used in the present example has features that are the same as or similar to those of the tube pump 200 of the reference example, except for the shape of a guide groove 300 in a roller holder 208 and matters related to the shape. Therefore, in the following description, common reference numerals are used for the present example and the reference example, and the description on the features of the tube pump 200 of the reference example is given also as a description on the features of the tube pump 200 of the present example. The difference between the tube pump 200 of the present example and the tube pump 200 of the reference example will be described in more detail later.

The tube pump 200 is a pump for sending liquid such as ink, and includes a tube 202, a frame 204, a plurality of rollers 206, and the roller holder 208. In this case, the liquid sent by the tube pump 200 can be regarded as an example of the fluid. The tube 202 is a tube through which the liquid sent by the tube pump 200 passes. In the present example, the tube 202 is a flexible tube having elasticity, and is disposed to be at least partially curved in an arc shape. More specifically, in the case of the illustrated configuration, the tube 202 is disposed to be partially curved in an arc shape along a support surface formed in the frame 204. In this case, the tube 202 can also be regarded as being disposed in a U shape, as illustrated in the figure for example. The frame 204 is a housing that holds the tube 202 and the roller holder 208, and holds a part of the tube 202 along the support surface curved in an arc shape, and holds roller holder 208 in such a manner that the support surface and part of the roller holder 208 face each other with the tube 202 interposed therebetween. Thus, the frame 204 holds the tube 202 in such a manner that the tube 202 is sandwiched between the support surface and the roller holder 208.

The plurality of rollers 206 are rollers for squeezing the tube 202, and for example, as illustrated in FIG. 2A, move along a partial zone of the flow path in which the liquid is sent through the tube 202, while crushing the tube 202, to push out the liquid inside the tube 202. In this case, the operation of the roller 206 can be regarded as, for example, an operation of squeezing the tube 202 in one direction along the tube 202 disposed in a U shape, or the like. The roller 206 has a shaft that is parallel to a direction orthogonal to a direction in which the roller moves while squeezing the tube 202, and is supported by the roller holder 208 with this shaft inserted in the guide groove 300 of the roller holder 208.

The roller holder 208 is a member that moves the roller 206 while holding the shaft of the roller 206, and makes the rollers 206 orbit around a predetermined center axis to make the rollers 206 repeatedly pass through a path along a partial zone of the tube 202. Making the roller 206 orbit around the center axis can be regarded as, for example, making the roller 206 move while making the shaft of the roller 206 orbit around an axis that is parallel to the shaft of the roller 206 and passes through a predetermined center position, or the like. The center axis is determined in accordance with, for example, the arc-shaped part of the tube 202. More specifically, in the present example, the center axis is an axis passing through the center of a circle corresponding to the arc-shaped part of the tube 202. The roller holder 208 is a wheel-shaped member that rotates around the center axis, and makes the plurality of rollers 206 orbit around the central axis, by rotating around the central axis while the shafts of the plurality of rollers 206 are being held in the plurality of respective guide grooves 300.

In the present example, the guide groove 300 in the roller holder 208 is a groove that penetrates the roller holder 208. The guide groove 300 can be regarded as, for example, a groove receiving the shaft of the roller 206 to define a range in which the roller 206 is movable with respect to the roller holder 208, or the like. The guide groove 300 can also be regarded as, for example, a configuration for guiding the movement of the roller 206 between a squeeze position and a retracted position that are described below, or the like. More specifically, in the case of the illustrated configuration, the guide groove 300 is a groove in which, during the forward rotation of the tube pump 200, the position on the rear end side is the squeeze position and the position on the front end side which is the other end is the retracted position. In this case, during the forward rotation of the tube pump 200 can be regarded as, for example, being in a state in which the roller holder 208 is rotated in an orientation for pushing out the liquid in the tube 202, or the like. During the forward rotation of the tube pump 200 can also be regarded as, for example, a state in which the rollers 206 are moved in an orientation for performing the liquid sending operation by the tube pump 200, or the like. In the case of the illustrated configuration, for example, the operation of rotating the roller holder 208 in the orientation of the arrow illustrated in FIG. 2A can be regarded as the operation during the forward rotation. The squeeze position can be regarded as, for example, the position of the roller 206 for performing the operation of squeezing the tube 202, or the like. Furthermore, in the case of the present example, the position in the guide groove 300 on the rear end side during the forward rotation is the squeeze position. Therefore, the squeeze position can also be regarded as, for example, an end position in the guide groove 300 on the rear side in the movement orientation (rear end position), or the like. The retracted position can be regarded as a position where the roller 206 separated from the tube 202 is retracted, or the like. In the present example, the retracted position is an end position (front end position) of the guide groove 300 on the side opposite to the squeeze position.

During the forward rotation, the roller 206 moving along a partial zone of the tube 202 is held at the squeeze position in the guide groove 300 of the roller holder 208, and thus moves while crushing the tube 202, as illustrated in FIG. 2A for example. In this case, the zone in which the roller 206 moves while crushing the tube 202 can be regarded as, for example, a squeeze zone in the moving range of the roller 206 orbiting around the center axis. Furthermore, in the present example, the squeeze zone is a zone including the arc-shaped part in the tube 202. According to the present example, for example, the tube 202 can be appropriately squeezed by the roller 206, so that the liquid in the tube 202 can be appropriately sent.

Furthermore, in the case of the illustrated configuration, a part other than the squeeze zone in the moving range of the roller 206 orbiting around the center axis, such as a zone indicated by a two-headed arrow in FIG. 2B for example, is a non-contact zone in which the roller 206 and the tube 202 do not come into contact with each other. In this case, for example, as illustrated in FIG. 2B, at the timing when the roller 206 moves into the non-contact zone after passing through the squeeze zone, the roller 206 is bounced up by the elastic force (resilience force) of the tube 202, and moves toward the retracted position on the other end side of the guide groove 300. Such a movement operation of the roller 206 can be regarded, for example, as an operation of moving in a direction away from the squeeze position in accordance with the elastic force of the tube 202, or the like. In this case, with the tube pump 200 of the reference example, a large hitting sound might be produced due to collision between the rollers 206 and a wall surface of the guide groove 300. On the other hand, in the tube pump 200 of the present example, the guide groove 300 has a shape different from that in the tube pump 200 of the reference example, for appropriately preventing the production of the large hitting sound. In view of this, the features of the tube pump 200 of the present example will be described in detail below.

Figure 3A:
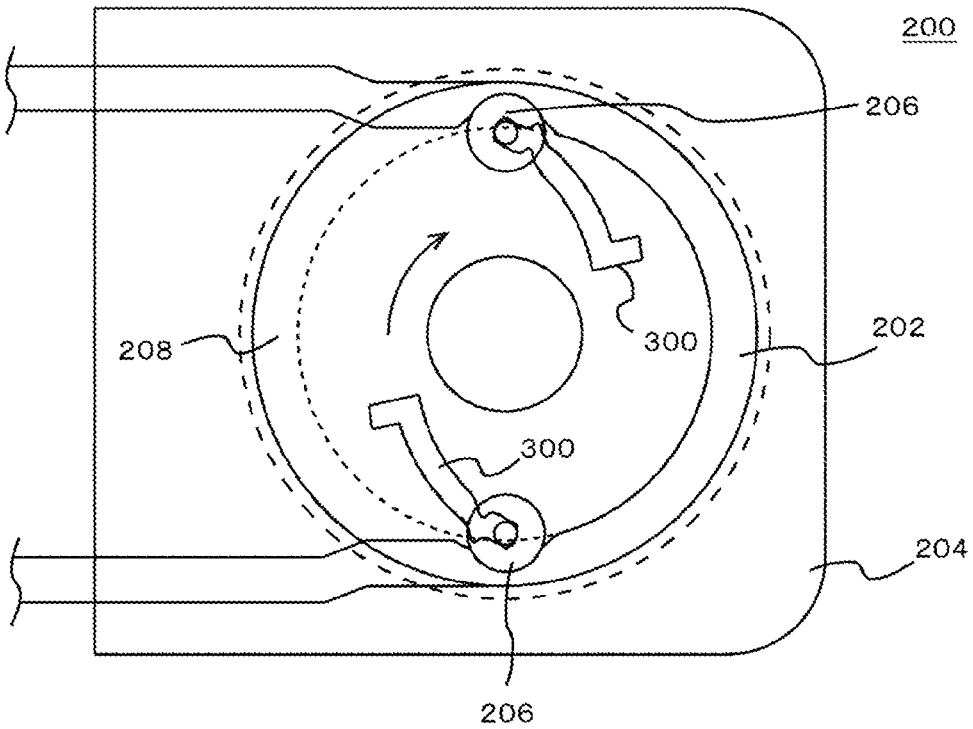
FIGS. 3A and 3B are diagrams illustrating features of a tube pump 200 of the present example in detail. Specifically.
Figure 3B:
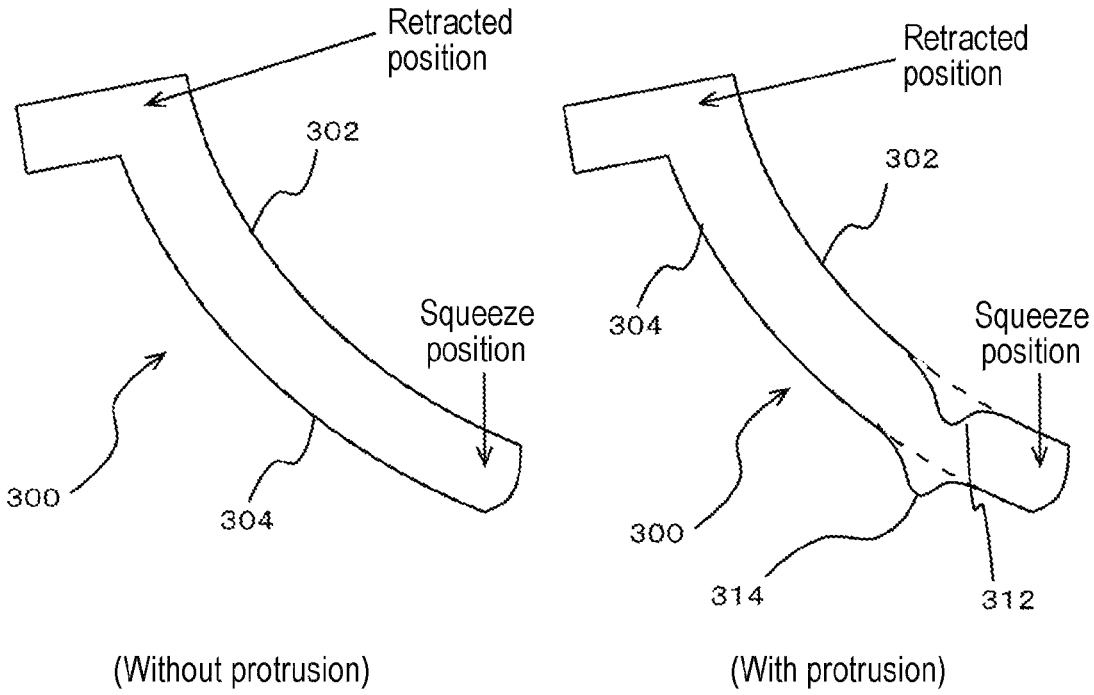

FIGS. 3A and 3B are diagrams illustrating the features of the tube pump 200 of the present example in detail. Specifically, FIG. 3A illustrates an example of a configuration of the tube pump 200 of the present example. FIG. 3B is a diagram illustrating shapes of the guide grooves 300 of the reference example and the present example for comparison. In FIG. 3B, the left drawing illustrates the shape of the guide groove 300 in the roller holder 208 in the tube pump 200 of the reference example. The right drawing illustrates the shape of the guide groove 300 in the roller holder 208 in the tube pump 200 of the present example.

As described above, the tube pump 200 of the present example has features that are the same as or similar to those of the tube pump 200 of the reference example, except for the shape of the guide groove 300 in the roller holder 208 and matters related to the shape. More specifically, as illustrated in the figure, the tube pump 200 of the present example includes the tube 202, the frame 204, the plurality of rollers 206, and the roller holder 208, as in the tube pump 200 of the reference example. The components in FIGS. 3A and 3B denoted with reference numerals that are the same as those in FIGS. 2A and 2B may have features that are the same as or similar to those of the components in FIGS. 2A and 2B, except for the points described below. The tube pump 200 may have features that are the same as or similar to those of known tube pumps, except for the points described below.

As illustrated in FIG. 3A, also in the tube pump 200 of the present example, the roller 206, in the squeeze zone during the forward rotation, is held at the squeeze position in the guide groove 300 to move while crushing the tube 202. Still, the shape of the guide groove 300 in the present example is different from that in the tube pump 200 of the reference example, resulting in a movement of the roller 206 at the timing of entering the non-contact zone after passing through the squeeze zone differing from that of the roller 206 of the reference example. The movement of the roller 206 of the present example will be described in more detail later.

Furthermore, in the present example and in the reference example, the guide groove 300 can be regarded as, for example, a groove in which one end side is the rear side and the other end side is the front side in the orientation in which the roller 206 moves along the squeeze zone during the forward rotation. As illustrated in FIG. 3B, the roller holder 208 has an inner side surface 302 and an outer side surface 304 as surfaces defining the guide groove 300. In this case, the inner side surface 302 can be regarded as, for example, a surface defining a side surface of the guide groove 300, on the inner side of the roller holder 208, or the like. The inner side of the roller holder 208 can be regarded as, for example, a side farther from the tube 202 regarding the positional relationship with respect to the tube 202 in the squeeze zone, or the like. The inner side surface 302 can also be regarded as, for example, a surface that guides the movement of the roller 206 on a side closer to the rotation center axis of the roller holder 208 than the shaft of the roller 206, or the like. The outer side surface 304 can be regarded as, for example, a surface defining a side surface of the guide groove 300 at a position more on the outer side of the roller holder 208 than the inner side surface 302, or the like. The outer side of the roller holder 208 can also be regarded as, for example, a side closer the tube 202 regarding the relationship with the tube 202 in the squeeze zone, or the like. The outer side surface 304 can also be regarded as, for example, a surface facing the inner side surface 302 with the shaft of the roller 206 interposed therebetween, or the like.

As can be understood from the illustrated configuration and the like, the roller holder 208 further includes, as surfaces defining the guide groove 300, surfaces connecting the inner side surface 302 and the outer side surface 304, on one end side and the other end side of the guide groove 300 that are the squeeze position and the retracted position. In the present example and the reference example, the guide groove 300 is bent at the retracted position as illustrated in the figure. Therefore, the roller holder 208 has a surface for forming such a bent portion as the surface connecting the inner side surface 302 and the outer side surface 304 on the retracted position side. With such a configuration, the guide groove 300 holds the shaft of the roller 206 at the squeeze position while the roller 206 moves along the squeeze zone during the forward rotation.

As illustrated in FIG. 3B for comparison, the guide groove 300 in the roller holder 208 of the tube pump 200 of the present example and the guide groove 300 in the roller holder 208 of the tube pump 200 of the reference example are different from each other by being provided with and not provided with a protrusion 312 for example. More specifically, in the present example, the inner side surface 302 of the guide groove 300 has the protrusion 312 protruding toward the outer side surface 304. The protrusion 312 can be regarded as, for example, a bump formed in the guide groove 300, or the like. In the tube pump 200 of the present example, the outer side surface 304 of the guide groove 300 has, at a position facing the protrusion 312 on the inner side surface 302, a recess 314 recessed in a direction away from the inner side surface 302, to correspond to the protrusion 312 provided to the inner side surface 302. In this case, the recess 314 is recessed to make the guide groove 300 have a width, at the position of the protrusion 312, not smaller than the width of the roller 206. With this configuration, for example, the roller 206 can be appropriately prevented from failing to pass through the position of the protrusion 312 in the guide groove 300. Furthermore, with this configuration, the width of the guide groove 300 can be appropriately secured also at the position provided with the protrusion 312, for example.

More specifically, a part of the inner side surface 302 of the guide groove 300 of the present example other than the protrusion 312 is curved to be closer to the center axis at a part farther from the squeeze position, for example. Considering the distance from the outer circumference of the roller holder 208, for example, the part of the inner side surface 302 other than the protrusion 312 can also be regarded as being curved to have a larger distance from the outer circumference of the roller holder 208 at a part farther from the squeeze position. In this case, the outer circumference of the roller holder 208 can be regarded as, for example, a position through which a part of the roller holder 208 farthest from the center axis passes as the roller holder 208 rotates, or the like.

On the other hand, in the present example, the protrusion 312 on the inner side surface 302 has a surface that is more separated from the center axis at a part farther from the squeeze position, to protrude toward the outer side surface 304. In this case, for example, as illustrated in the figure, at least part of the surface, of the surfaces defining the protrusion 312, on the side closer to the squeeze position can be regarded as the surface that is more separated from the center axis at a part farther from the squeeze position. The protrusion 312 can also be regarded, for example, as including a part that is closer to the outer circumference of the roller holder 208 at a part farther from the squeeze position. With such a configuration, for example, the protrusion 312 can be appropriately formed on the inner side surface 302 for example. In this case, the guide groove 300 in the tube pump 200 of the reference example can be regarded, for example, as being curved to be closer to the center axis at a part farther from squeeze position, over the entirety of the inner side surface 302.

In the present example, with the guide groove 300 being provided with the protrusion 312, during the forward rotation of the roller holder 208, the roller holder 208 holds the shaft of the roller 206 between the rear end position of the guide groove 300 and the protrusion 312. With this configuration, the roller 206 is held at the rear end position of the guide groove 300 by the roller holder 208, also while being separated from the tube 202 in the non-contact zone after passing through the squeeze zone. With this configuration, the roller 206 can be appropriately prevented from moving to the retracted position in the guide groove 300 during the forward rotation, for example. Thus, even when the roller 206 receives, from the tube 202, force in a direction away from the squeeze position in the guide groove 300, it is possible to appropriately and surely prevent the roller 206 from dislodging from the squeeze position and colliding with the opposite end of the guide groove with a huge momentum, for example. Thus, it is possible to appropriately prevent production of large hitting sound due to collision between the wall surface of the guide groove 300 and the roller 206 for example. All things considered, according to the present example, the tube pump 200 featuring excellent quietness can be appropriately provided for example. Furthermore, with such a tube pump 200 used in the printing apparatus 100 (see FIG. 1), the printing apparatus 100 featuring excellent quietness can be appropriately provided for example.

Here, in the present example, the operation of holding the shaft of the roller 206 by means of the guide groove 300 during the forward rotation can be regarded as, for example, an operation of holding the shaft of the roller 206 on one end side of the guide groove 300 regardless of whether the roller 206 is in contact with the tube 202. Furthermore, as can be understood from the matters described above and the like, the protrusion 312 may be formed to prevent the shaft of the roller 206 from moving beyond the protrusion 312, toward the retracted position side during the forward rotation, without compromising the function of the guide groove 300 for example. More generally, the protrusion 312 can also be regarded, for example, as functioning to attenuate the momentum of the roller 206 dislodging from the squeeze position. In this case, the attenuation of the momentum of the roller 206 can be regarded, for example, as reducing the momentum of the roller 206 from that in the case where the guide groove 300 not having the protrusion 312 formed is used, or the like. The use of the guide groove 300 not having the protrusion 312 formed can be regarded, for example, as a use of a guide groove 300 corresponding to a configuration obtained by removing the protrusion 312 from the guide groove 300 in the tube pump 200 of the present example, or the like. The guide groove 300 corresponding to a configuration obtained by removing the protrusion 312 can be regarded, for example, as being the same as or similar to the guide groove 300 in the tube pump 200 of the reference example, or the like. The guide groove 300 corresponding to a configuration obtained by removing the protrusion 312 can be regarded as, for example, using the inner side surface 302 smoothly curved due to the absence of the protrusion 312 as illustrated in a broken line in the right diagram in FIG. 3B, or the like.

Furthermore, in the present example, the protrusion 312 is formed between the squeeze position and the retracted position in the guide groove 300 and in the vicinity of the squeeze position, for example, as illustrated in the figure. In this case, for example, the protrusion 312 may be formed to come into contact with the roller 206 at a timing when the roller 206 that has passed through the squeeze zone is separated from the tube 202. The protrusion 312 coming into contact with the roller 206 can be regarded as, for example, the protrusion 312 coming into contact with the shaft of the roller 206, or the like. The timing at which the roller 206 that has passed through the squeeze zone is separated from the tube 202 can be regarded as, for example, a timing at which the roller 206 moves into the non-contact zone from the squeeze zone due to the rotation of the roller holder 208, or the like. The timing at which the roller 206 moves into the non-contact zone from the squeeze zone can be regarded as, for example, a timing including immediately before the roller 206 is separated from the tube 202, or the like. In the case of the tube pump 200 of the present example, immediately before the timing when the roller 206 is separated from the tube 202, the roller 206 is in contact with the tube 202 at a position near the end of the arc-shaped part of the tube 202. In this case, at the timing of passing through the squeeze zone, the roller 206 is separated from the tube 202 by being at a position other than the curved part in the tube 202. It is conceivable that the part of the tube 202 in contact with the roller 206 gradually expand from the crushed state as the roller 206 moves. In this case, the gradual expansion of the tube 202 immediately before the timing when the roller 206 is separated from the tube 202 can be regarded as, for example, gradual reduction in the level of crushing of the tube 202 at the position in contact with the roller 206 from that in a state where the level of crushing of the tube 202 is the highest in the squeeze zone, as a result of the movement of the roller 206, or the like.

Furthermore, in this case, the protrusion 312 on the inner side surface 302 of the guide groove 300 can be regarded as, for example, coming into contact with the roller 206 pushed away from the squeeze position by the gradually expanding tube 202 while the tube 202 and the roller 206 are in contact with each other, or the like. By being in contact with the roller 206 receiving the elastic force from the gradually expanding tube 202, for example, the protrusion 312 prevents the movement of the shaft of the roller 206 toward the retracted position side beyond the protrusion 312, that is, toward the front side beyond the protrusion 312 in the guide groove 300 during the forward rotation or the tube pump 200, at the timing when the roller 206 is separated from the tube 202. Thus, at the timing when the roller 206 passes through the squeeze zone due to the rotation of the roller holder 208 during the forward rotation, the protrusion 312 prevents the roller 206, receiving the force in the direction away from the squeeze position from the tube 202, from moving beyond the protrusion 312. With this configuration, for example, the shaft of the roller 206 can be appropriately held between the squeeze position and the protrusion 312 in the guide groove 300, during the forward rotation of the tube pump 200. Therefore, according to the present example, for example, the roller 206 can be prevented from colliding with the wall surface of the guide groove 300 at the retracted position. Thus, it is possible to more appropriately prevent production of large hitting sound due to collision between the wall surface of the guide groove 300 and the roller 206 for example.

In this case, for example, the protrusion 312 can also be regarded as regulating the movement of the roller 206 at the timing when the roller 206 is separated from the tube 202 for example. Furthermore, for example, the protrusion 312 can also be regarded as pressing the roller 206, until the expanded state of the tube 202 is achieved for example.

In the tube pump 200, a backward rotation operation of rotating the roller holder 208 in an orientation opposite to that during the forward rotation may be performed. In the case of the tube pump 200 of the present example, during the backward rotation, the roller holder 208 holds the shaft of the roller 206 to be more on the retracted position side than the protrusion 312 in the guide groove 300. In this case, the retracted position side in the guide groove 300 can be regarded as, for example, the other end side opposite to the one end side where the shaft of the roller 206 is held during the forward rotation, or the like. With this configuration, for example, the roller holder 208 can be appropriately rotated backward, with the roller 206 appropriately retracted to a position to be not in contact with the tube 202 for example.

Although not illustrated in FIGS. 2A and 2B and FIGS. 3A and 3B, the tube pump 200 may further include, for example, an elastic member or the like that comes into contact with the roller 206 when the roller holder 208 rotates. For example, the elastic member comes into contact with the roller 206 moving in the rotation direction of the roller holder 208 to move the roller 206 toward the rear side in the rotation direction. Thus, the elastic member moves the roller 206 to the squeeze position during the forward rotation of the tube pump 200, and moves the roller 206 to the retracted position during the backward rotation of the tube pump 200, for example. As such an elastic member, a member that is the same as or similar to an elastic member used for known tube pumps can be suitably used.

Next, supplementary description as well as description on modifications, and the like of the configuration described above will be given. As can be understood from the above description and the like, the shape of the protrusion 312 of the guide groove 300 is not limited to the shape specifically illustrated in FIG. 3B and can be changed in various manner, as long as large hitting sound can be appropriately prevented from being produced as a result of collision between the wall surface of the guide groove 300 and the roller 206. In such a case, for example, the shape and arrangement of the protrusion 312 are preferably determined according to characteristics such as the size and elasticity of the tube 202 (see FIGS. 3A and 3B).

In this regard, for the sake of prevention of the movement the roller 206 beyond the protrusion 312, the protrusion 312 can be regarded as preferably being formed to have a large size or a high protruding height. However, with such a configuration, backflow of liquid is likely to occur during the backward rotation. More specifically, as described above, during the backward rotation, for example, the rotation of the roller holder 208 causes the roller 206 to move from the squeeze position to the retracted position. However, the protrusion 312 having a large size or the like makes the movement of the roller 206 from the squeeze position to the retracted position difficult, and this may result in a higher possibility of occurrence of backflow of a slight amount of liquid.

Thus, the shape of the protrusion 312 is preferably determined while further taking the appropriate prevention of the backflow into consideration. In this case, the position and the shape of the protrusion 312 may be determined in such a manner that the amount of backflow occurring falls within a tolerable range set in advance, for example. More specifically, for example, the height of the protrusion 312 may be set to a height with which the movement of the roller 206 from the squeeze position to the retracted position during the backward rotation is not hindered. In this case, the movement of the roller 206 is not hindered can be regarded as, for example, the problem of backflow of liquid not occurring due to the influence of the protrusion 312, or the like. Furthermore, for preventing the backflow of liquid during the backward rotation, for example, a width of the guide groove 300 at the position of the protrusion 312 may be set to be wider than that in other parts, or the other like configuration may be employed. In this case, for example, the guide groove 300 may have a large width at the position of the protrusion 312. with the recess 314 having a recessed amount overwhelming the protruding height of the protrusion 312.

As can be understood from the above description and the like, the tube 202 may be used while switching between the forward rotation operation and the backward rotation operation as appropriate. The roller 206 moves beyond the protrusion 312 in the guide groove 300, at each of a timing of switching from the forward rotation to the backward rotation and a timing of switching from the backward rotation to the forward rotation. Thus, preferable shapes of the guide groove 300 and the protrusion 312 can be regarded to be, for example, shapes for holding the roller 206 on the rear end side in the rotation direction of the roller holder 208 during each of the forward rotation and the backward rotation, and enabling the roller 206 to move over the protrusion 312 when the rotation direction of the roller holder 208 is changed. With this configuration, the forward rotation operation and the backward rotation operation of the tube pump 200 can be appropriately performed.

Furthermore, in the present example, the roller 206 at the retracted position during the backward rotation is maintained in a state of receiving no elastic force from the tube 202, by not being in contact with the tube 202. In this case, the prevention of the movement of the roller 206 using the protrusion 312 can be regarded to be, for example, particularly important during the forward rotation of the tube pump 200. Thus, the protrusion 312 may be formed to have a shape with the inclination on the squeeze position side (one end side) being larger than the inclination on the retracted position side (other end side) for example. In this case, the shape with the inclination on the squeeze position side being larger than the inclination on the retracted position side can be regarded as, for example, a shape with the maximum inclination on the squeeze position side being larger than the maximum inclination on the retracted position side, or the like. With this configuration, for example, the roller 206 can more appropriately move beyond the protrusion 312 when the backward rotation is switched to the forward rotation, while more surely preventing the roller 206 from moving over the protrusion 312 during the forward rotation.

As can be understood from the configuration illustrated in FIGS. 3A and 3B and the like, the guide groove 300 may be formed as a through hole penetrating the roller holder 208 formed as an integral object, for example. In this case, the wall surfaces of the guide grooves 300 such as the inner side surface 302 and the outer side surface 304 can be regarded as, for example, being made of a material that is the same as that of the roller holder 208. On the other hand, in a modification of the configuration of the guide groove 300, for example, as illustrated in FIG. 4A, the protrusion 312 may be formed as a separately formed retrofit member or the like.

Figure 4A:
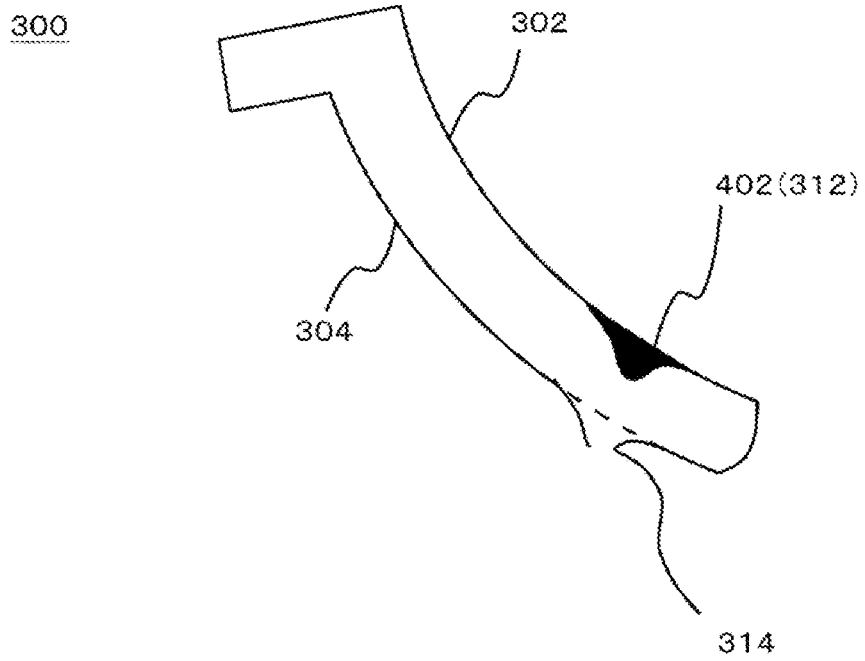
FIGS. 4A to 4C illustrate various modifications of the configuration of the guide groove 300.
Figure 4B:
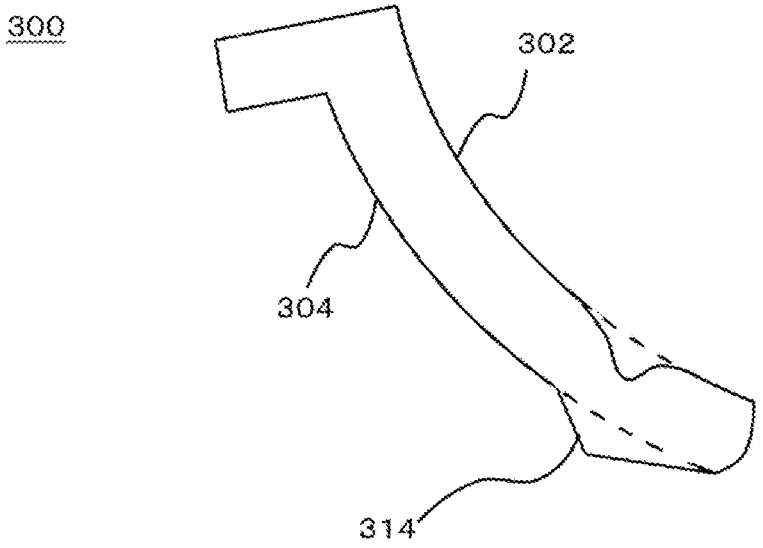
Figure 4C:
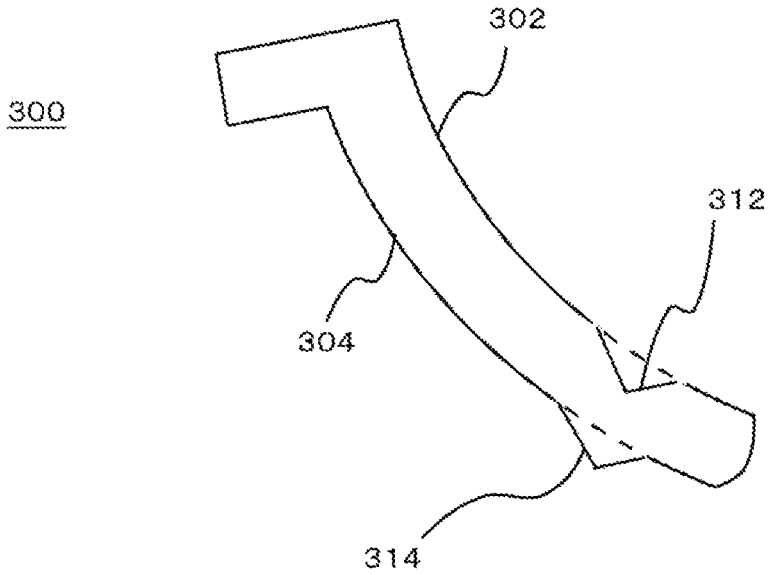
Figure 5A:
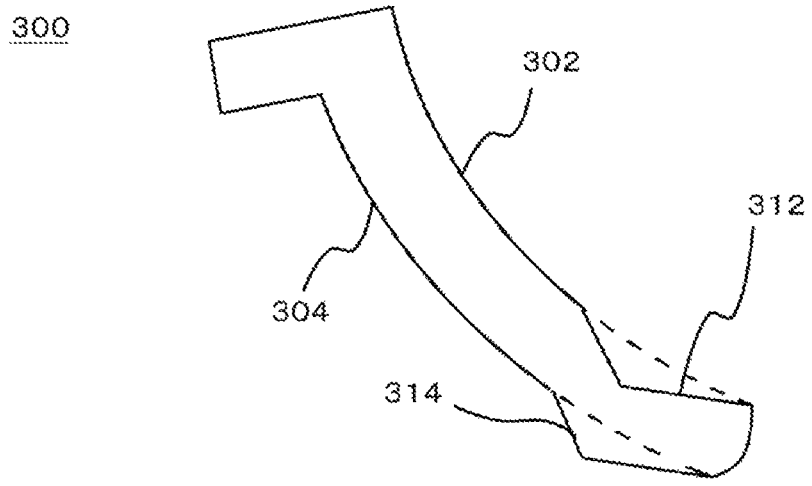
FIGS. 5A to 5C illustrate various modifications of the configuration of the guide groove 300.
Figure 5B:
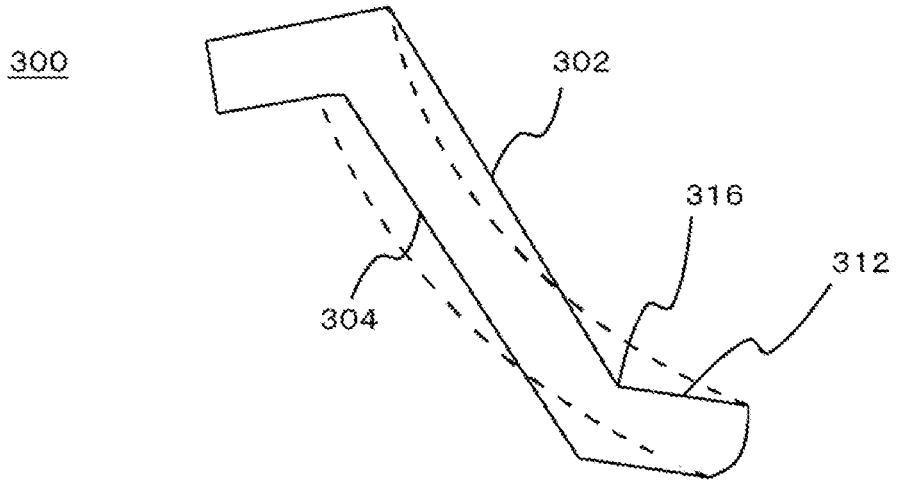
Figure 5C:
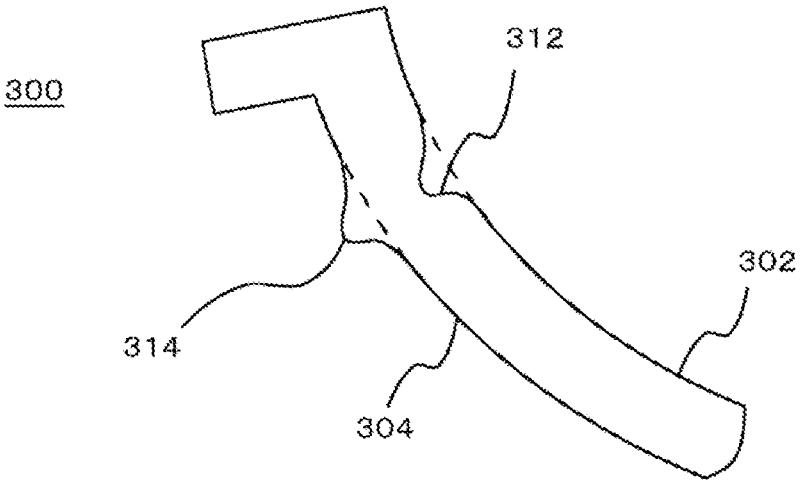

FIGS. 4 and 5 are diagrams illustrating modifications of the configuration of the guide groove 300. FIGS. 4A to 4C and FIGS. 5A to 5C illustrate various modifications of the configuration of the guide groove 300. In the modification illustrated in FIG. 4A, the protrusion 312 is formed by a retrofit protruding member 402. In this case, a through hole corresponding to a part of the guide groove 300 other than the protrusion 312 may be formed in the roller holder 208 (see FIG. 3A), and then the protruding member 402 may be attached to a predetermined position of the through hole, for example. Also with this configuration, for example, the function of the protrusion 312 described above can be appropriately implemented. In this case, with the protrusion 312 formed by the protruding member 402, for example, the protrusion 312 of various shapes can be formed more easily and appropriately. Thus, various adjustment on the characteristics of the protrusion 312 and the like are further enabled, for example. As the protruding member 402, for example, a rubber member made of rubber or the like can be suitably used. The protruding member 402 is not limited to a rubber member, and members made of various materials may also be used. In this case, for example, an elastic material, or a material having a cushioning property superior to that of the material forming the wall surfaces of the guide groove 300 in parts other than the protrusion 312 may be used. The material having the superior cushioning property can be regarded, for example, as a material with a superior capability of absorbing an impact upon colliding with another member, or the like. With this configuration, in cases such as that when the shaft of the roller 206 collides with the protrusion 312, an impact of the collision can be appropriately reduced for example. As the protruding member 402, for example, a member made of a material that is the same as that of the wall surface of the guide groove 300 in parts other than the protrusion 312 may be used.

In the above description, the configuration in which the recess 314 is formed in accordance with the shape of the protrusion 312 is mainly illustrated and described. On the other hand, the shape of the recess 314 may have a shape that is not the same as that of the protrusion 312. In this case, the shape of the recess 314 being the same as that of the protrusion 312 can be regarded as, for example, the surfaces defining the protruding shape of the protrusion 312 being the same as the surfaces defining the recessed shape of the recess 314, or the like. More specifically, for example, as illustrated in FIG. 4B, the recess 314 may be formed to have a shape different from that of the protrusion 312. In this case, for example, the recess 314 may have a shape that is easily processed compared with a case where the shape is the same as that of the protrusion 312, or the like. For example, as illustrated in FIG. 4B, when the protrusion 312 is formed with a curved surface, the recess 314 may be formed to have a flat surface or the like. Furthermore, the recess 314 may be formed in a range wider than that facing the protrusion 312, as illustrated in FIG. 4B for example. In the above description, the configuration in which the protrusion 312 is formed to have a curved surface is mainly illustrated and described. With such a configuration, for example, the protrusion 312 of various shapes can be appropriately formed. Thus, for example, the protrusion 312 with a shape with which the roller 206 is difficult to move toward the retracted position side beyond the protrusion 312 during the forward rotation, but can easily move beyond the protrusion 312 when the rotation direction of the roller holder 208 is changed can be appropriately formed. On the other hand, depending on the quality and the like required for the tube pump 200, for example, the protrusion 312 having a flat surface may be formed as illustrated in FIG. 4C, or the like. With this configuration, the protrusion 312 can be more easily processed for example.

Furthermore, in the above description, the configuration in which the protrusion 312 is formed at a position slightly separated from the rear end of the guide groove 300 during the forward rotation is mainly illustrated and described. In this case, the protrusion 312 may be positioned to enable the shaft of the roller 206 to be held between the protrusion 312 and the rear end position of the guide groove 300. More specifically, the protrusion 312 may be positioned to make a distance between the protrusion 312 and the rear end position of the guide groove 300 not smaller than the width of the shaft of the roller 206. With this configuration, for example, the protrusion 312 can be appropriately prevented from affecting the roller 206 held at the squeeze position. Furthermore, in this case, the distance between the protrusion 312 and the rear end position of the guide groove 300 can be regarded as, for example, a distance between the rear end position of the guide groove 300 and a part of the inner side surface 302 that is raised relative to other parts due to the presence of the protrusion 312, or the like. Furthermore, this distance can also be regarded as, for example, a distance between a position of the hem of the protrusion 312 where raising in a direction away from the center axis of the roller holder 208 starts and the rear end position of the guide groove 300, or the like.

On the other hand, in a modification of the configuration of the guide groove 300, for example, as illustrated in FIG. 5A, the protrusion 312 may be formed to protrude toward the outer side surface 304 from a position closer to the rear end of the guide groove 300, or the like. In this case, for example, as indicated by a broken line in the figure, the protrusion 312 can be regarded as a part protruding toward the outer side surface 304 from a virtual position smoothly continuing to a part of the inner side surface 302 forming the retracted position side. In this case, for example, a state where the shaft of the roller 206 is held between the apex of the protrusion 312 and the rear end position of the guide groove 300 during the forward rotation can be regarded as the shaft of the roller 206 being held between the rear end position of the guide groove 300 and the protrusion 312. Also with the protrusion 312 thus formed, for example, large hitting sound can be appropriately prevented from being produced due to collision between the wall surface of the guide groove 300 and the roller 206, as long as the protrusion 312 is formed to make the shaft of the roller 206 held between the protrusion 312 and the rear end position of the guide groove 300 during the forward rotation. Also in the case of the modification illustrated in FIG. 5A, a part with a surface that is more separated from the center axis at part farther from the squeeze position can be regarded, for example, as the protrusion 312, as in the configuration described above.

Considering such a feature of the protrusion 312, the protrusion 312 can also be regarded, for example, as being formed in the guide groove 300 illustrated in FIG. 5B. More specifically, in the modification illustrated in FIG. 5B, the guide groove 300 has a bent portion 316 where the inner side surface 302 and the outer side surface 304 are bent. Thus, part of the inner side surface 302 can be regarded as a surface that is more separated from the center axis at a part farther from the squeeze position. Thus, also in this case, the guide groove 300 can be regarded as having the protrusion 312. Also with this configuration, for example, large hitting sound can be appropriately prevented from being produced due to collision between the wall surface of the guide groove 300 and the roller 206, as long as the protrusion 312 is formed to make the shaft of the roller 206 held between the protrusion 312 and the rear end position of the guide groove 300 during the forward rotation, for example.

As described above, for example, the guide groove 300 with the configuration illustrated in FIG. 5B or the like can also be regarded as being capable of preventing large hitting sound from being produced due to the collision between the wall surface of the guide groove 300 and the roller 206. However, in this case, the presence of the protrusion 312 affects the entirety of the inner side surface 302 and the outer side surface 304, and this may result in the shape of the guide groove 300 being difficult to design or the like. Thus, for example, the protrusion 312 is preferably be of a shape defined by part of the inner side surface 302 protruding, as in the configuration illustrated in FIG. 3B and FIGS. 4A to 4C for example. The protrusion 312 is preferably formed to be less likely to affect the roller 206 at the squeeze position for example. In view of this, the protrusion 312 is more preferably formed at a position separated from the rear end of the guide groove 300 as in the configuration illustrated in FIG. 3B and FIGS. 4A to 4C or the like.

Furthermore, in the above description, the configuration in which the protrusion 312 is formed at a position close the rear end of the guide groove 300 during the forward rotation is mainly illustrated and described. On the other hand, for the sake of attenuation of the momentum of the roller 206 before reaching the retracted position, the protrusion 312 may be formed at a position closer to the retracted position as illustrated in FIG. 5C for example, or the like. More specifically, the guide groove 300 with the configuration illustrated in FIG. 3B and FIGS. 4A to 4C or the like can be regarded, for example, as having the protrusion 312 formed at a position closer to the rear end (rear end during the forward rotation) than to the front end (front end during the forward rotation) in the guide groove 300. On the other hand, in the guide groove 300 illustrated in FIG. 5C, the protrusion 312 can be regarded, for example, as being formed at a position closer to the front end than to the rear end in the guide groove 300, that is, at a position closer to the retracted position. Furthermore, in this case, the protrusion 312 may be formed at a position also separated from the retracted position at the front end of the guide groove 300, to make the roller 206 come into contact with the protrusion 312 before reaching the retracted position.

When the protrusion 312 is formed as illustrated in FIG. 5C, at a timing when the roller 206 enters the non-contact zone after passing through the squeeze zone due to the forward rotation of the roller holder 208, the roller 206 separated from the tube 202 moves toward the retracted position, and during the movement, the roller 206 collides with the protrusion 312, for example. In this case, it is conceivable that hitting sound is produced by the collision between the protrusion 312 and the roller 206. Still, in this case, it is possible to make the hitting sound produced when the protrusion 312 and the roller 206 come into contact with each other small, as compared with the hitting sound produced by the collision between the front end of the guide groove 300 and the roller 206 in a case where the protrusion 312 is not formed for example. More specifically, for example, when the roller 206 collides with the front end of the guide groove 300 in the state without the protrusion 312 formed, for example, the roller 206 collides with the wall surface of the guide groove 300 while moving substantially linearly, resulting in production of large hitting sound. On the other hand, when the protrusion 312 and the roller 206 come into contact with each other before the roller 206 reaches the retracted position, with the surface defining the protrusion 312 inclined with respect to the moving direction of the roller 206 for example, the impact of the collision can be reduced. Thus, it is possible to appropriately prevent production of large hitting sound for example. Also in this case, the protrusion 312 is preferably formed in such a manner that the roller 206 does not move beyond the protrusion 312 during the forward rotation. The protrusion 312 may also be formed to be in a shape with which the roller 206 moves beyond the protrusion 312 for example, or the like. In this case, for example, the protrusion 312 may be formed so as not to stop the movement of the roller 206 completely upon coming into contact with the roller 206, but to attenuate the momentum of the movement of the roller 206. Also with this configuration, the volume of the hitting sound produced by the contact between the protrusion 312 and the roller 206 can be appropriately reduced, for example. Furthermore, in this case, with the momentum of the movement of the roller 206 attenuated by the protrusion 312, even when the roller 206 collides with the wall surface of the guide groove 300 at the front end of the guide groove 300 thereafter, the volume of the hitting sound produced by the collision can be appropriately reduced, for example.

To attenuate the momentum of the roller 206 before reaching the retracted position, also in a case where the protrusion 312 is formed at a position closer to the rear end of the guide groove 300 during the forward rotation in a further modification of the guide groove 300, the protrusion 312 may be formed to have a shape with which the roller 206 moves beyond the protrusion 312 at a timing when the roller 206 enters the non-contact zone after passing through the squeeze zone, or the like. Also in this case, by attenuating the momentum of the movement of the roller 206 with the protrusion 312, the production of large hitting sound can be appropriately prevented, compared with a case where the protrusion 312 is not formed, for example.

In the above description, the configuration in the case of ejecting the ink on the medium is mainly described for the printing apparatus 100 (see FIG. 1). In this case, the printing apparatus 100 can be regarded as an inkjet printer or the like that forms a two-dimensional image on a medium. On the other hand, according to a modification of the configuration of the printing apparatus 100, a 3D printer (3D printing apparatus) or the like shaping a shaped object may be used as the printing apparatus 100. Also in this case, with the tube pump 200 described above, the printing apparatus 100 featuring excellent quietness can be appropriately provided for example.

INDUSTRIAL APPLICABILITY

The present disclosure can be suitably used for, for example, a tube pump.

What is claimed is:

1. A tube pump configured to send a fluid by using an elastic tube, the tube pump comprising:

the tube through which the fluid passes;

a roller configured to move along a partial zone in a flow path in which the fluid is sent through the tube, while crushing the tube, to push out the fluid in the tube; and a roller holder configured to make the roller orbit around a predetermined center axis to make the roller repeatedly pass through a path along the partial zone, the roller holder being a member that makes the roller move while holding a shaft of the roller, wherein in the roller holder, a guide groove is formed to have one end side and another end side, in a movement orientation in which the roller moves along the partial zone to push out the fluid, respectively defined as a rear side and a front side, the guide groove being a groove that receives the shaft of the roller to define a range in which the roller is movable with respect to the roller holder, wherein the guide groove is configured for guiding a movement of the roller between a squeeze position and a retracted position, wherein the squeeze position is disposed on the one end side, and the retracted position is disposed on the another end side, the roller holder includes, as surfaces defining the guide groove, an inner side surface that is a surface guiding a movement of the shaft of the roller on a side closer to the center axis than the shaft of the roller, and an outer side surface that is a surface facing the inner side surface with the shaft of the roller interposed in between, while the roller moves along the partial zone, the shaft of the roller is held at a rear end position that is a position at an end on the rear side in the movement orientation in the guide groove, and the inner side surface has a protrusion protruding toward the outer side surface, wherein the protrusion is provided between the squeeze position and the retracted position, the outer side surface has a recess recessed in a direction away from the inner side surface, at a position of the inner side surface facing the protrusion, and wherein the inner side surface is formed in an arc shape which is interrupted by the protrusion such that the arc shape extends on both sides of the protrusion.

2. The tube pump according to claim 1, wherein the tube is disposed to be at least partially curved in an arc shape, the roller holder makes the roller orbit around the center axis, by rotating around the center axis determined based on a part of the tube having the arc shape, while the shaft of the roller is being held by the guide groove, the roller is separated from the tube at a timing when the roller passes through the partial zone, and while the roller holder rotates in an orientation in which the fluid is pushed out, the roller holder holds the shaft of the roller between the rear end position of the guide groove and the protrusion.

3. The tube pump according to claim 2, wherein during backward rotation of the roller holder rotating in an orientation opposite to the orientation in which the fluid is pushed out, the roller holder holds the shaft of the roller to be disposed between the another end side and the protrusion in the guide groove.

4. The tube pump according to claim 3, wherein the protrusion has a shape with an inclination larger on the one end side than an inclination on the another end side.

5. The tube pump according to claim 1, wherein a part of the tube in contact with the roller immediately before the timing at which the roller is separated from the tube gradually expands from a crushed state as the roller moves, and the protrusion on the inner side surface comes into contact with the roller pushed by the tube gradually expanding, to prevent the roller from moving toward the another end side beyond the protrusion in the guide groove.

6. A printing apparatus configured to perform printing based on an inkjet method by using the tube pump according to claim 1, the printing apparatus comprising:

an inkjet head configured to eject ink;

an ink container configured to store the ink supplied to the inkjet head; and an ink supply path through which the ink is supplied from the ink container to the inkjet head by using the tube pump.

7. A printing apparatus configured to perform printing based on an inkjet method by using the tube pump according to claim 1, the printing apparatus comprising:

an inkjet head configured to eject ink; and a maintenance unit configured to perform maintenance on the inkjet head, wherein the maintenance unit sucks ink from the inkjet head by using the tube pump.

8. The tube pump according to claim 2, wherein a part of the tube in contact with the roller immediately before the timing at which the roller is separated from the tube gradually expands from a crushed state as the roller moves, and the protrusion on the inner side surface comes into contact with the roller pushed by the tube gradually expanding, to prevent the roller from moving toward the another end side beyond the protrusion in the guide groove.

9. The tube pump according to claim 3, wherein a part of the tube in contact with the roller immediately before the timing at which the roller is separated from the tube gradually expands from a crushed state as the roller moves, and the protrusion on the inner side surface comes into contact with the roller pushed by the tube gradually expanding, to prevent the roller from moving toward the another end side beyond the protrusion in the guide groove.

10. The tube pump according to claim 4, wherein a part of the tube in contact with the roller immediately before the timing at which the roller is separated from the tube gradually expands from a crushed state as the roller moves, and the protrusion on the inner side surface comes into contact with the roller pushed by the tube gradually expanding, to prevent the roller from moving toward the another end side beyond the protrusion in the guide groove.

* * * * *